United States Patent [19]

Corblick

[11] Patent Number: 4,619,492

[45] Date of Patent: Oct. 28, 1986

[54] ELECTRICAL CONNECTOR WITH ONE-HAND DISCONNECT

[76] Inventor: Robert F. Corblick, 14830 - 58th St. N. - #515, Stillwater, Minn. 55082

[21] Appl. No.: 697,626

[22] Filed: Feb. 4, 1985

[51] Int. Cl.[4] ..... H01R 13/62

[52] U.S. Cl. ..... 339/45 R

[58] Field of Search ..... 339/45, 46, 91 R, 61, 339/63

[56] References Cited

U.S. PATENT DOCUMENTS

| | | | |
|---|---|---|---|
| 2,051,425 | 8/1936 | Schlums | 339/45 R |
| 3,008,115 | 11/1961 | Oakes | 339/45 R |
| 4,042,292 | 8/1977 | Chensky | 339/45 R |
| 4,140,359 | 2/1979 | Kunz | 339/45 R |
| 4,193,656 | 3/1980 | Ward | 339/45 M |

FOREIGN PATENT DOCUMENTS

| | | | |
|---|---|---|---|
| 0039548 | 11/1981 | European Pat. Off. | 339/45 R |

*Primary Examiner*—Gil Weidenfeld
*Assistant Examiner*—David L. Pirlot
*Attorney, Agent, or Firm*—Douglas L. Tschida

[57] ABSTRACT

An electrical connector for convenience appliances and the like including a pair of resilient L-shaped members attached to opposed sides thereof. Upon plugging the connector into an appliance, its removal is achieved by squeezing a pair of flat portions on the finger members inwardly and which causes the finger members to exert a retraction force against the appliance.

5 Claims, 2 Drawing Figures

ELECTRICAL CONNECTOR WITH ONE-HAND DISCONNECT

BACKGROUND OF THE INVENTION

The present invention relates to an electrical connector for convenience appliances and, in particular, to a connector including ejector means comprising a pair of resilient fingers mounted to the connector and which in a one-hand fashion permit the removal of the connector from the appliance.

A problem, more often than not, that arises with convenience appliances having removable power cords is that of the user wanting to remove the power cord before the appliance has had a sufficient amount of time to cool. Accordingly, in order to remove the power cord, it is necessary to brace one hand against the appliance, along a relatively cool portion, while removing the power cord by grasping the phenolic connector between the thumb and index finger. While the desired result is achieved with this latter operation, one does not always have two free hands. Also, given the possibility, where such appliances are most commonly encountered, of having moist hands, in the kitchen and bathroom environments, an electrical hazzard is posed to the user, should he or she be grounded to the appliance, while removing the power cord and possibly contacting one of the electrified terminals.

In order to overcome the foregoing problems, it is contemplated that some type of ejector mechanism might find advantageous use, especially a connector and ejector mechanism that can be used with a single hand. Upon a review of the prior art, a number of ejector mechanisms have been developed, some of which mount to the wall receptacle itself (e.g. U.S. Pat. Nos. 2,464,413; 2,551,533; and 4,042,292). A number of other mechanisms have been developed for inclusion with the connector itself and some of which can be seen upon directing attention to U.S. Pat. Nos. 1,072,460; 2,142,284; 2,445,608; 3,440,405; and 4,140,359. The latter devices each operate in conjection with a linear pushing member and/or a caming action to extract the connector from the appliance. Additionally, U.S. Pat. No. 4,140,359 discloses a device wherein the linear pusher member includes a resilient bent portion that may be depressed and which in so doing causes the pusher member to eject the connector. A problem of this and other linear pusher member containing types of ejectors, however, is that of the possibility of the pusher member breaking and which can occur for relatively tight fitting connectors. Also, because of the application of the ejection force on a relatively small area, the magnitude of the ejection pressure is somewhat large and can over time result in excessive wear at the pushing surface of the appliance.

In order to apply the ejection force over a somewhat larger area, the present invention contemplates an electrical connector including a pair of resilient bent finger members that mount to adjacent sides of the electrical connector. Each of the finger members is generally "L" shaped and each includes a flat finger receiving portion. Upon depressing each of the fingered members, for example, by a squeezing action of the thumb and index finger, the finger members flatten against the connector and exert a reverse or extracting motion against the appliance. Now, however, the extraction force is applied at two points of contact and which readily removes, even the most stubborn of connectors.

The above objects, advantages, and distinctions, as well as the construction of the present invention, will, however, be discussed in more detail hereinafter with respect to the following description and appended drawings. Before referring to the description, though, it is to be recognized that it is made with respect to the presently preferred embodiment only and which is not intended to be all inclusive and as such should not be interpreted in any way to be as self limiting.

SUMMARY OF THE INVENTION

An electrical connector for convenience appliances and the like for facilitating the one hand in removal of the power cord therefrom. The connector includes a pair of finger member receiving slots and into which individual L-shaped resilient members are mountable. Each of the L-shaped members is fabricated from a relatively hard resilient material having shape retaining properties so as to permit the resilient deflection thereof. A pair of flat surfaces at the junction of the arms of the L-shaped member permit the exertion of the finger pressure thereon and the deflection of the L-shaped members against the connector. The distal ends of the L-shaped members thereby exert an extraction force against the appliance which causes the removal of the connector from the appliance.

DESCRIPTION OF THE PREFERRED EMBODIMENT

Figure 1:
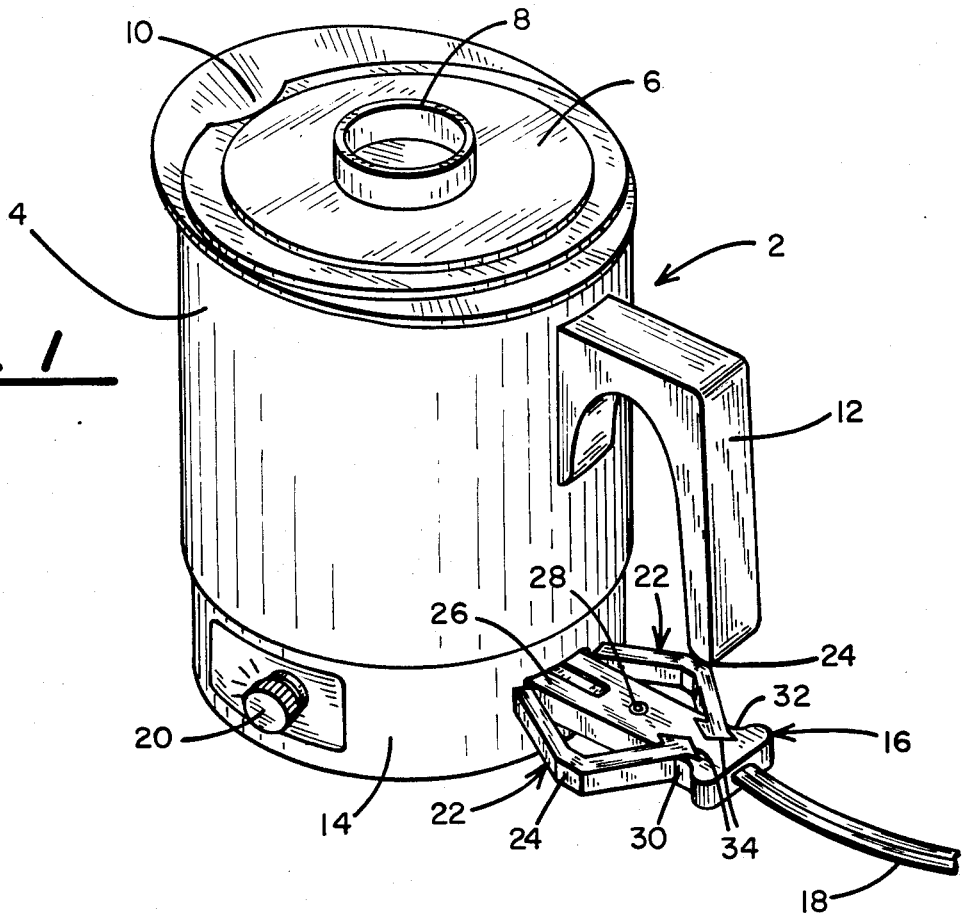
FIG. 1 shows a perspective assembly view of a typical convenience appliance including the present one-handed connector.

Directing attention of FIG. 1, a perspective view is shown of a typical convenience appliance 2 and which as depicted is a portable appliance for heating a variety of liquids that are placed therein. The appliance 2 thus includes an upper container portion 4 wherein the liquid can be placed and in relation to which a handle 8 containing cover member 6 can be attached. A spout 10 formed in the cover and the container 4, along with a handle 12 facilitate subsequent removal after heating. The heating of the contents, in turn, is achieved via a heating element (not shown) mounted in the base 14 of the appliance 2 and which is connected to an appropriate source of power via a detachable connector 16 and cord 18. An appurtenant control knob 20 also provides some control over the heating element and the temperature to which the liquid matter is raised.

While a heating pot 2 has been depicted, it is to be recognized that any number of home convenience appliances are essentially comprised of the same elements as the present hot pot 2. Examples of some of these appliances are curling irons, blow dryers, electric skillets, electric woks, electric hot plates and coffee pots, to name but a few. While the application may vary with each appliance, each typically includes a heating element that receives its power from a detachable power cord. The power cord is being removed by holding the appliance with one hand, grasping the power cord connector with the other and exerting a pulling extraction pressure. Upon removing the power cord, the appliance and power cord are typically stored away as desired.

As mentioned, even though each of these appliances may provide some convenience to the homeowner, more often than not, the actual removal of the power cord can present an inconvenience. That is, should the appliance still be hot, when the cord is being removed, it oftentimes is difficult to find a portion that can be held with one hand while removing the cord. Similary, if the homeowner is in the bath or kitchen, his or her hands may have moisture thereon from doing dishes and the like and which presents an unsafe condition during the connector removal. In order to overcome these problems, the present connector has been fabricated with a pair of integrally included resilient L-shaped ejection members 22 integrally included. Upon grasping a pair of flat side portions 24 of each of the resilient members 22 between the thumb and index finger and squeezing the members 22 against the connector body 26, the unrestrained distal ends of the members 22 are caused to be displaced toward the appliance 2 until they contact the appliance 2 and exert an extraction pressure against it. Once a sufficient extraction pressure is achieved, the connector 16 is caused to slide rearwardly from the terminals of the appliance. Upon releasing the members 22, they then return to their undeflected shape.

Figure 2:
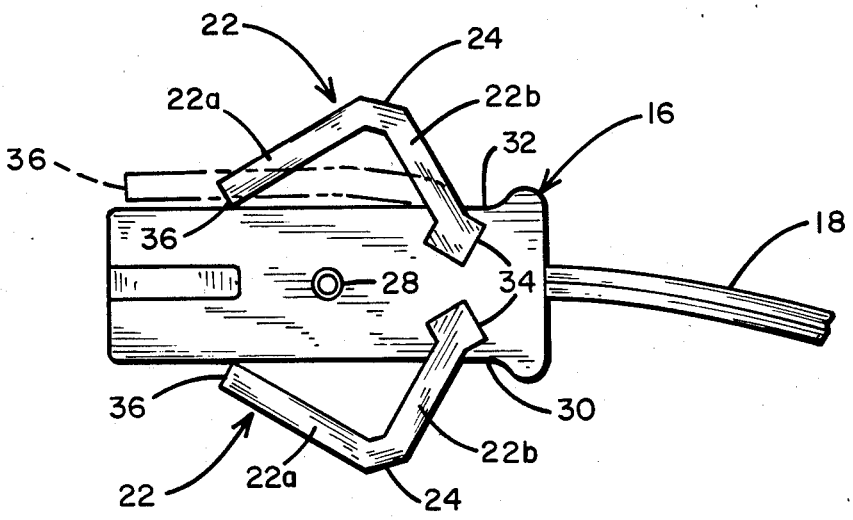
FIG. 2 shows a top view of the present one-handed connector.

Turning attention next to FIG. 2, a detailed top view is shown of the connector 16 of FIG. 1. It principally comprises a conventional molded electrically insulated body member 26 that is formed as upper and lower mating halves and which are held together with a rivet 28. The snout portion thereof, in turn, includes an appropriate number of female slide connectors (not shown) for receiving the male tanged members (not shown) of the appliance itself. Typically, two slide assemblies are included in the snout and each of which also include a clamp member (not shown) for attaching to one of the conductors of a two conductor power cord 18. As presently fabricated, the body 26 of the connector has also been elongated somewhat at its rear end to facilitate the grasping and insertion of the connector 16 into the appliance 2. That is, the connector can be grasped between the thumb and the index finger along the rear curved side surfaces 30 and 32 during the insertion process.

Also formed through the connector body 26 are a pair of appropriately shaped keyed slots 34. Each of the slots 34 receives one mating proximal end of one of the resilient L-shaped members 22 and because of the slot shape, confines the L-shaped members 22 thereto. In the presently preferred embodiment, a square slot shape is used, although other shapes can also be used equally well so long as they prevent pulling the L-shaped member 22 out of the sides of the connector body 26. can also be used equally well.

Turning attention to the individual L-shaped members 22, each is fabricated with a flat region 24 at the outer intersection of the elongated arms **22*a* and 22*b* thereof and which flats 24 facilitate the previously mentioned removal. Alternatively, the flats 24 can be curved slightly inward so as to better receive the thumb and index finger and prevent their slippage therefrom. Each of the L-shaped members 22 are presently constructed from a relatively stiff rubber having a sufficient durometer so as to return to the shape depicted, once the connector 16 is removed from the appliance 2. However, the material is sufficiently resilient so as to permit the flexing thereof inwardly against the connector body 26**.

This latter condition is shown in dotted line in FIG. 2 and wherein it is to be noted that upon squeezing the finger members 22, the arms **22*a* and 22*b* tend to flatten against the connector body 26 and the distal end of each arm 22*a* is caused to be extended along the sides of the connector. In this regard, too, the inner surface of intersection of the arms 22*a* and 22*b* is flattened slightly to facilitate the flattening of the arms against the connector 16. As an aside and while not presently provided, an insert material of a density approximating the connector body 26 itself might also be included with each arm 22*a* in the region of sliding contact with the connector body 26 to minimize wear. The distal end surface 36 of each finger member 22 is thus brought to bear against the appliance 2 in a non-scuff fashion so as to induce a rearwardly directed extraction force thereat. Because the finger members 22 are relatively stiff, they do not flex but instead induce the connector body 26 to slide rearwardly, until the female slide connectors are free of the male tangs in the appliance 2. In actual practice, it is anticipated that the length of the arms 22*a* and 22*b* would be adjusted relative to the length of throw necessary to release the prongs. In this regard, too, it is contemplated that the size and mounting angle of the finger members 22** would be adjusted to maintain a relatively low profile without becoming overly cumbersome.

The present connector 16 thus enables the one-handed removal of the power cord 18 from the appliance, while distributing the removal forces over multiple contact surfaces surrounding the connector and which facilitates removal, especially for sticky connections. Further, it does so in a fashion that does not require a significant modification of the molds for existing connectors. Still further, it does so with materials that are electrically insulative and also does so in a low profile design that accommodates appliances having plug connectors which mount relatively close to the supporting surface.

While the present invention has been described with respect to its presently preferred embodiment, it is to be recognized that various modifications may be made thereto by those of skill in the art without departing from the spirit and scope hereof. For example, the connector 16 and is L-shaped members 22 might be molded as a single unit or the L-shaped members 22 might be hinged at the intersection of the arms **22*a* and 22*b*** or include additional L-shaped members for bulky connectors. Accordingly, it is contemplated that the following claims should be interpreted to include all those equivalent embodiments within the spirit and scope thereof.

What is claimed is:

1. An electrical connector for a detachable power cord comprising:

(a) an electrically insulated body member including at least one connector element coupled to an insulated electrical conductor, said connector element mounted in alignment with a contact surface of said body member at which an electrical connection is made; and (b) first and second compressively resilient pusher members mounted exteriorly of the body member in longitudinally extensible relation thereto, each pusher member having a proximal end of a first arm portion coupled to the body member and a distal end thereof coupled to a second arm portion, whereby upon simultaneously squeezing the pusher members at the juncture of their first and second arm portions inwardly toward the body member, a distal end of each second arm portion expands in generally parallel relation to the external sides of the body member to exert a rearwardly directed extraction force remote from said contact surface.

2. Apparatus as set forth in claim 1 wherein each of said pusher members includes a flat region at the juncture of its first and second arm portions.

3. Apparatus as set forth in claim 1 wherein said body member includes first arm portion receiving slots formed in opposed relation to one another along an axis orthogonal to the course of travel of each of said pusher members and extending inwardly from the sides of said body member.

4. Apparatus as set forth in claim 3 wherein said slots and the proximal end of each first arm portion is rectangular.

5. An electrical connector for a detachable power cord comprising:

(a) an electrically insulated body member including at least one connector element coupled to an insulated electrical conductor, said connector element mounted in alignment with a contact surface of said body member at which an electrical connection is made; and (b) first and second hinge members mounted exteriorly of said body member, each hinge member coupled at a proximal end to the body member and such that upon simultaneously squeezing each hinge member in proximity to a jointed portion thereof, a distal end of each hinge member expands exteriorly and in substantially unrestrained relation of the body member to exert a rearwardly directed extraction force remote from said contact surface.

* * * * *